US010306964B1

(12) United States Patent
Daniels

(10) Patent No.: US 10,306,964 B1
(45) Date of Patent: Jun. 4, 2019

(54) CANNOLI HAIR ROLLER AND CANNOLI ROLLER CLASP

(71) Applicant: Nancy Ann Daniels, Hilliard, OH (US)

(72) Inventor: Nancy Ann Daniels, Hilliard, OH (US)

( * ) Notice: Subject to any disclaimer, the term of this patent is extended or adjusted under 35 U.S.C. 154(b) by 114 days.

(21) Appl. No.: 14/999,628

(22) Filed: Jun. 8, 2016

(51) Int. Cl.
*A45D 2/14* (2006.01)
*A45D 2/12* (2006.01)

(52) U.S. Cl.
CPC ..... *A45D 2/148* (2013.01); *A45D 2/122* (2013.01)

(58) Field of Classification Search
USPC ..... 132/226, 236, 243; D28/35
See application file for complete search history.

(56) References Cited

U.S. PATENT DOCUMENTS 1,969,300 A * 8/1934 Eberhard ..... A45D 2/34 132/220
2,409,081 A * 10/1946 Torrens ..... A45D 6/00 132/226
3,173,430 A * 3/1965 Brien ..... A45D 2/10 132/252
3,759,271 A * 9/1973 Caruso ..... A45D 4/10 132/233
3,838,700 A * 10/1974 Barrios ..... A45D 2/14 132/254
4,984,591 A * 1/1991 Jacobi ..... A45D 2/14 132/226
5,706,838 A * 1/1998 St. James ..... A45D 2/18 132/246
2002/0134397 A1* 9/2002 Hester ..... A45D 2/2407 132/210
2007/0169788 A1* 7/2007 Liao ..... A45D 2/146 132/248
2009/0255549 A1* 10/2009 Smith ..... A45D 2/148 132/245
2010/0252062 A1* 10/2010 Gregorek ..... A45D 2/122 132/200

* cited by examiner

*Primary Examiner* — Nina Bhat

(57) ABSTRACT

The Cannoli Hair Roller and Cannoli Roller Clasp is the first hair roller design to achieve "on base", which is on the scalp stability. This design represents the ideal hair roller that professional cosmetologists have sought to make hair setting easier and more successful. The invention's unique design gives the cosmetology community what it has always been seeking, which is an "on base" hair roller that is true to being "on base" for the first time in the history of hair roller sets of any nature. This invention gives more hair volume and lift with easier styling ability, and the hair set lasts far longer than ordinary hair rollers. This invention delivers the perfect hair set.

20 Claims, 7 Drawing Sheets

Cannoli Hair Roller
End View

A: 45 degrees of arc
B: 55 degrees of arc

Canoli Hair Roller
Side View

Cannoli Hair Roller
End View

A: 45 degrees of arc
B: 55 degrees of arc

Cannoli Hair Roller
Bottom View

Universal hair pin hole dimensions.
Height 3/16 inch
Width 1/8 inch

Cannoli Roller Clip
Side view

Cannoli Roller Clip
End View

A: 45 degrees of arc
B: 55 degrees of arc

X Universal hair pin hole positions.

Cannoli Roller Clip
Bottom View

Cannoli Hair Roller
Examples of Correct Placement
on the Scalp

CANNOLI HAIR ROLLER AND CANNOLI ROLLER CLASP

FIELD OF THE INVENTION

The present invention relates to a hair roller with a completely new, unique and innovative design to be perfectly touching the surface of the scalp, (which is known as being "on base") and being secure, as no other hair roller has ever been. The present invention also relates to a hair clasp specially designed for the new and unique hair roller.

BACKGROUND OF THE INVENTION

Various kinds of hair styles and hair cuts have long been used to express originality and individual beauty. In many of these styles, this is accomplished by curling the hair. The curled state of the hair is retained by the Cannoli Hair Roller.

Hair rollers have been generally fashioned as cylindrical shapes. They are essentially molds around which the hair is wound and curls are formed to create volume. After the hair is wound around the Cannoli Hair Roller, it is secured in place by means of the Cannoli Roller Clasp, or with additional universal hair pins and/or universal hair clips. This places the hair shafts on the roller under tension. The effect of the tension adds curl and volume to the hair.

The process of winding hair onto the Cannoli Hair Roller consists of several steps. First, the hair is sectioned into parts sized to the width and length of the Cannoli Hair Roller. For short or medium length hair take a section of hair and start to wind the hair around the Cannoli Hair Roller making sure that the flat base of the roller is seated on the scalp. Once this is accomplished, fasten the Cannoli Hair Roller with the Cannoli Roller Clasp and/or additional universal hair pins and hair clips. For long hair take a section of hair and place the Cannoli Hair Roller on the middle of the hair shaft winding the end of the hair shaft around the Cannoli Hair Roller first. Then wind the Cannoli Hair Roller down towards the scalp maneuvering the flat base of the Cannoli Hair Roller to touch the scalp. Secure the Cannoli Hair Roller in place with the Cannoli Roller Clasp, universal hair pins, and/or universal hair clips. Optimal volume is achieved when the Cannoli Hair Roller is totally "on base" to the scalp.

The present invention, the Cannoli Hair Roller and Cannoli Hair Clasp (hereafter referred to as the "invention"), is made to add maximum volume and curl to the hair and give longer lasting hair sets. This is achieved by the unique design of the "invention", which allows it to be placed perfectly "on base" every time with no compromise.

BRIEF SUMMARY OF INVENTION

The "invention" adds maximal volume and curl to the hair by being placed perfectly "on base" every time. The design features of the "invention" are specific for this purpose.

One primary design feature of the "invention" is a flat bottom surface. When the "invention" is in its final position, the flat bottom surface rests directly and securely on the scalp. This perfect "on base" positioning minimizes unwanted rocking or other movement of the invention, after it is secured in place. Perfect "on base" positioning allows the "invention" to be more securely in place on the scalp. This minimizes accidental falling out of the "invention" with head movements. Additionally, the perfect "on base" positioning maximizes the volume and curl of the hair. This leads to easier, more professional looking comb outs done in less time.

An additional advantage of the flat bottom surface is greater comfort when wearing the "invention". This "invention" can be worn while walking, sleeping, working, or doing a number of different activities in greater comfort than with conventional hair rollers.

Another unique design feature are the ends of the "invention", which are angled inward from the top surface to the flat roller bottom. The angled ends result in several benefits. There is less bumping between the individual Cannoli Hair Rollers while they are being applied and while they are in place. This leads to less sliding out of hair clips and hair rollers. There is also more space between the Cannoli Hair Rollers for the hair setter's fingers and for more hair clips to be applied as needed. The "invention" can therefore be placed in the hair more easily and more quickly. This feature allows for professional hair sets to be done better and more quickly.

The Cannoli Roller Clasp (hereafter the "clasp") is specially designed to fit the unique design features of the Cannoli Hair Roller (hereafter the "roller"). The open gap at the bottom of the "clasp" clasps around the flat bottom surface of the "roller". The ends of the "clasp" are angled inward from the top surface to the bottom surface to match the angled ends of the "roller". Lastly, the holes in the "clasp" match the holes in the "roller" in their positions and size.

DETAILED DESCRIPTION OF THE INVENTION

Figure 1A:
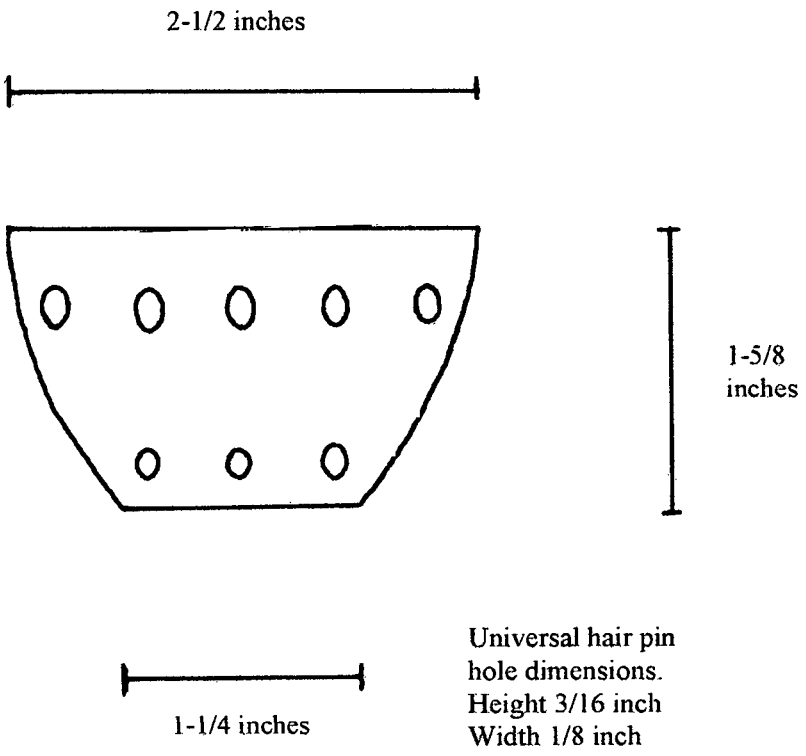
FIG. 1A is a side elevation view of a version of the hair roller.

FIG. 1A is a schematic view of the side of the "roller". The side view of the "roller" demonstrates the shape of the "roller" and the positions of the universal hair pin holes.

The top surface of the "roller" measures 2½ inches in length. The bottom surface measures 1¼ inches in length. The height of the "roller" is 1⅝ inches. The middle of the top and bottom surfaces are on the same vertical axis.

At the ends of the "roller", the top and bottom surfaces are connected by smooth angled ends. These angled ends allow for more rollers to be placed on the head. The angled ends also decrease bumping between rollers and minimize stray hair ends slipping out of the roller.

This view also shows the two rows of universal hairpin holes along the length of the "roller". There are two rows of universal hairpin holes on each side of the "roller" for a total of four rows of universal hairpin holes. Each universal hairpin hole measures 3/16 of an inch in height and 1/8 of an inch in width.

The top row of universal hairpin holes is positioned at a 45 degree angle from the center of the top surface. The top row consists of five holes. The center hole is located on the vertical center axis of the "roller". The next two holes are located 1/2 of an inch to either side of the center hole. The final two holes are located 1 inch to either side of the center hole. The bottom row of holes is positioned at a 55 degree angle below the top row of universal hairpin holes. The bottom consists of three holes, the center hole is located on the vertical center axis of the "roller". The remaining two holes are located 1/2 of an inch to either side of the center hole.

The universal hairpin holes are positioned so that the "roller" can be held in place on the head with universal hairpins.

The universal hairpin hole positions on the "roller" are in alignment with the universal hairpin holes on the "clasp". Universal hairpins could be used to further secure the "roller" and the "clasp" together on the head, if desired.

Figure 1B:
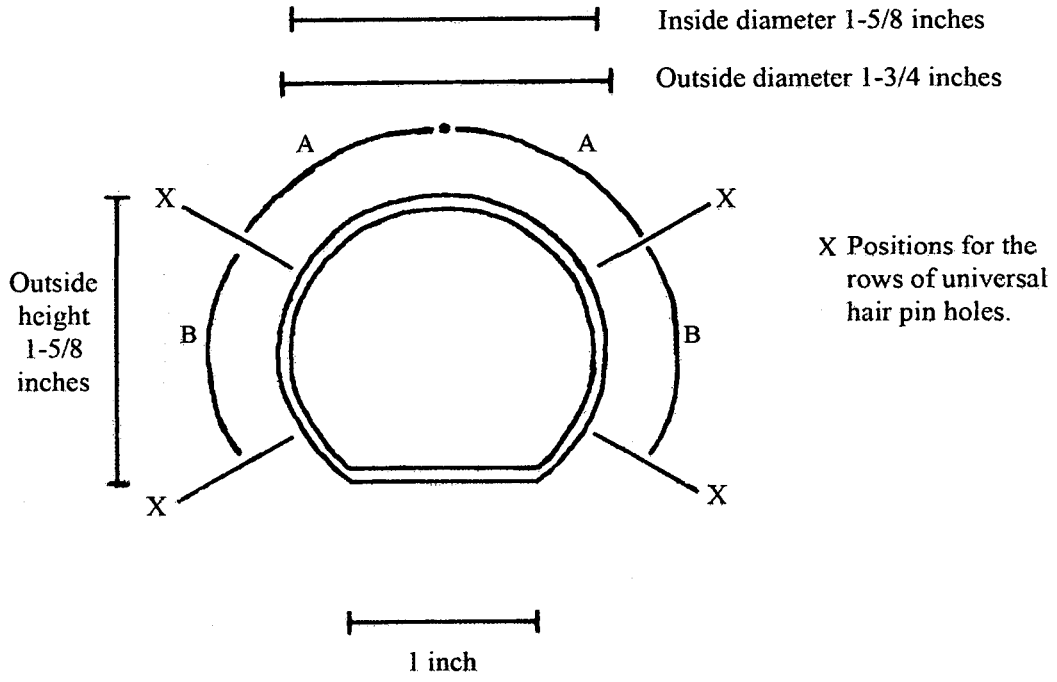
FIG. 1B is a end elevation view of the version shown in FIG. 1A.

FIG. 1B is a schematic view of the end of the "roller".

This view of the "roller" demonstrates the round shape top and side surfaces and the flat bottom surface of the "roller". The flat bottom is specially designed for the "roller" to hold the hair "on base" for the perfect hair set. The flat bottom prevents rocking and stray hair ends slipping out of the "roller".

The "X" marked lines indicate the positions of the rows of universal hairpin holes. The top rows of universal hairpin holes are located at a 45 degree angle on either side of the top center. The lower rows of universal hairpin holes are located at a 55 degree angle below the top, rows of holes. Each universal hairpin hole measures 3/16 of an inch in height and 1/8 of an inch in width. In position and size, they match exactly with the universal hairpin holes on the "clasp". This allows the "roller" and the "clasp" to be secured together with universal hairpins.

Figure 1C:
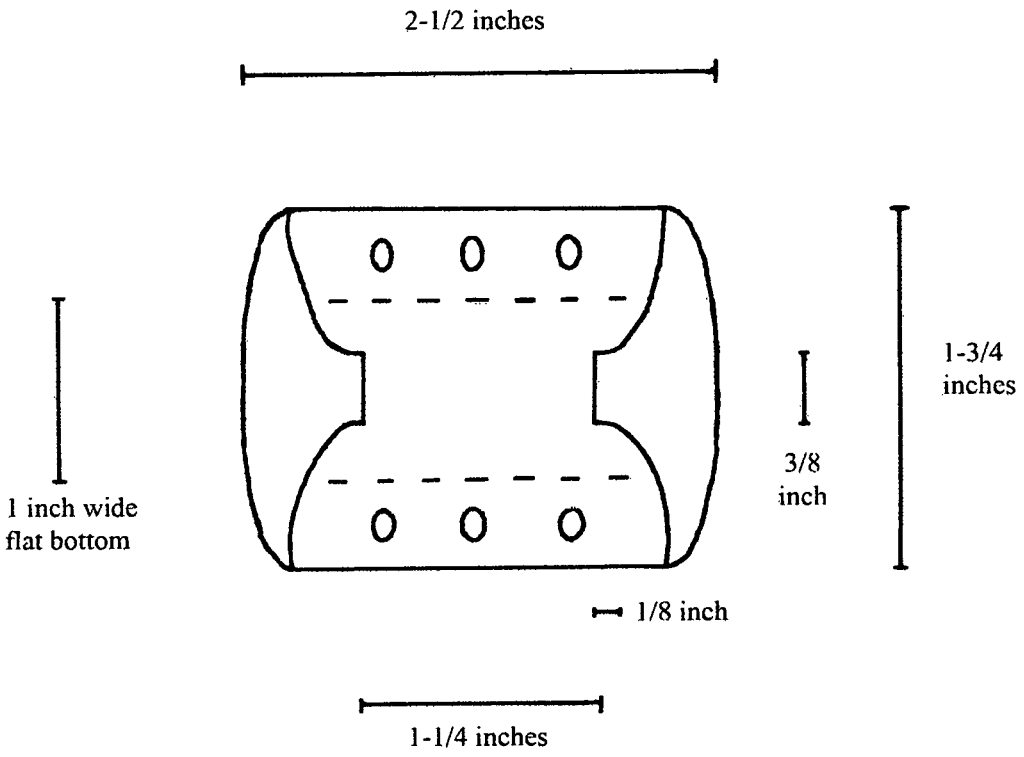
FIG. 1C is a bottom plan view of the version shown in FIG. 1A.

FIG. 1C is a schematic view of the bottom surface of the "roller". This view demonstrates the relationship between the design features at the bottom of the "roller". Along the bottom of the "roller", there is a 1 inch wide flat surface. It extends along the length of the bottom of the "roller". This unique feature allows the "roller" to sit perfectly "on base" on the scalp. This design feature minimizes roller side-to-side "rocking" movement. The "roller" design is the first hair roller to use a flat bottom surface to secure the roller perfectly "on base" on the scalp. This unique design feature will result in a perfect "on base" hair roller set.

Along the bottom center line there are two base notches, one at each end. They are open to the ends of the roller. The two base notches are specifically designed to fit universal hair clips. The universal hair clips can be used to secure the "roller" perfectly "on base". The base notches measure 1/8 of an inch in length and 3/8 of an inch in width.

Along with the other design features, the flat bottom allows the roller set to be completed in less time. The design prevents roller rocking, roller bumping and fall-out of rollers, hairpins and hair clips. The "roller's" design allows for more working room for the hair setters' hands and a faster, more secure set. Also shown are the two lower rows of universal hairpin holes. They are located at a 55 degree angle below the top rows of universal hairpin holes. They exactly match the size and position of the universal hairpin holes on the "clasp".

Figure 2A:
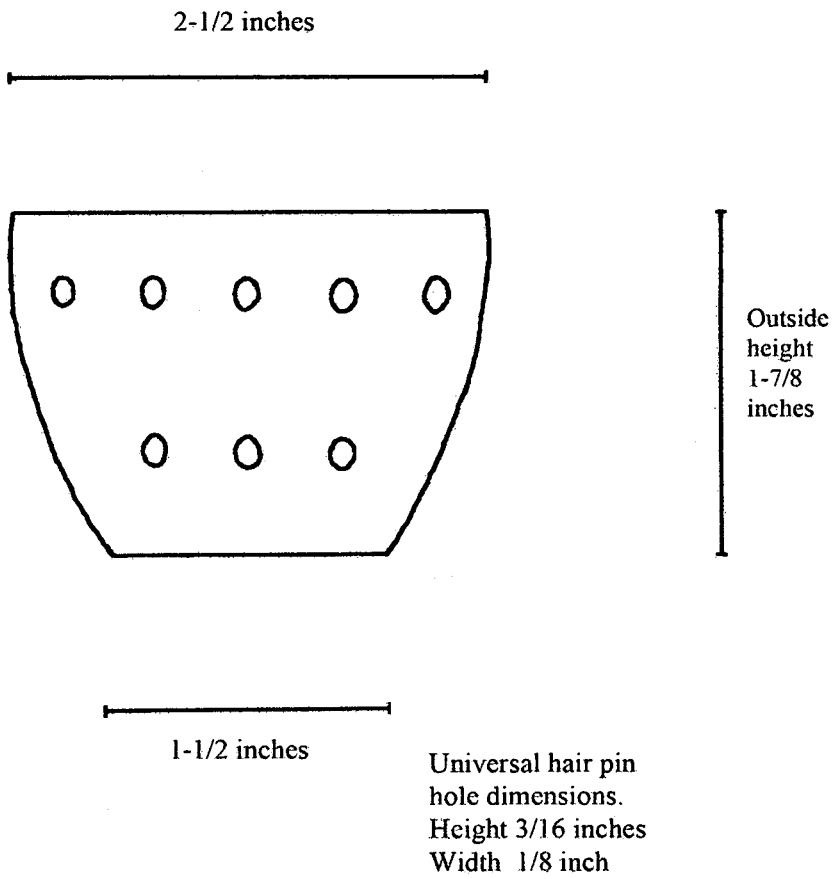
FIG. 2A is a side elevation view of a version of the clasp.

FIG. 2A is a schematic view of the side of the "clasp". The side view of the "clasp" demonstrates its unique shape and dimensions.

The top surface of the "clasp" measures 2 1/2 inches in length. The bottom surface measures 1 1/2 inches in length. The top and bottom surfaces are centered along the vertical center axis of the hair clasp.

The ends of the "clasp" are continuous, smooth and angled inward from the top surface to the bottom surface. The angled ends of the "clasp" match the angled ends of the "roller". The shape of the "clasp" enhances the design advantages of the "roller". Namely, there is less roller rocking and less bumping between rollers and less stray hair ends slipping out of the "roller".

The "clasp" measures 1 7/8 inches from the top surface to the gap at the bottom of the "clasp".

There are two rows of universal hairpin holes on each side of the "clasp". The size and positions of the universal hairpin holes exactly match those on the "roller".

The top row of universal hairpin holes is positioned at a 45 degree angle from the center of the top surface. The top row consists of five holes. The center hole is located on the vertical center axis of the "roller". The next two holes are located 1/2 of an inch to either side of the center hole. The final two holes are located 1 inch to either side of the center hole.

The bottom row of holes is positioned at a 55 degree angle below the top row of universal hairpin holes. The bottom consists of three holes. The center hole is located on the vertical center axis of the "clasp". The remaining two holes are located 1/2 of an inch to either side of the center hole. The positions of the universal hairpin holes on the other side of the "clasp" are similar. Each universal hairpin hole measures 3/16 of an inch in height and 1/8 of an inch in width.

Figure 2B:
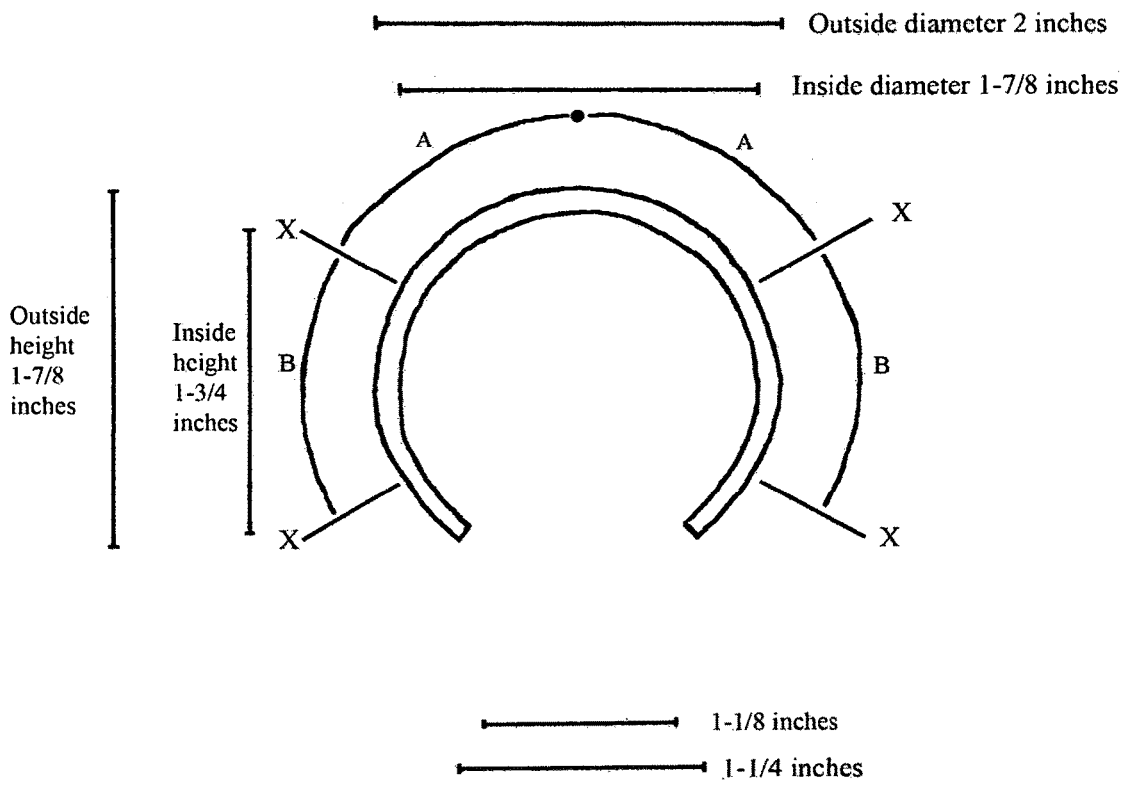
FIG. 2B is an end elevation view of the version shown in FIG. 2A.

FIG. 2B is a schematic view of the end of the "clasp".

The end view of the "clasp" shows that it is a partially open circle. It has a 1 1/8 inch wide open gap at the bottom. The gap is designed to fit over and around the "roller", "on base", and on the head. The outside diameter of the "clasp" is 2 inches. The "clasp" measures 1/8 of an inch in thickness. The "clasp" measures 1 7/8 inches from its top surface to the bottom gap opening.

The arrows in the diagram indicate the positions of the four rows of the universal hairpin holes. The top rows are located at a 45 degree angle on either side of the top center. The top row consists of five holes. The center hole is located on the vertical center axis of the "roller". The next two holes are located 1/2 of an inch to either side of the center hole. The final two holes are located 1 inch to either side of the center hole.

The bottom rows of holes are located at a 55 degree angle below the top rows of holes. The bottom consists of three holes. The center hole is located on the vertical center axis of the "roller" The remaining two holes are located 1/2 inch to either side of the center hole.

The universal hairpin holes exactly match the universal hairpin holes in the "roller" in size and positions.

Figure 2C:
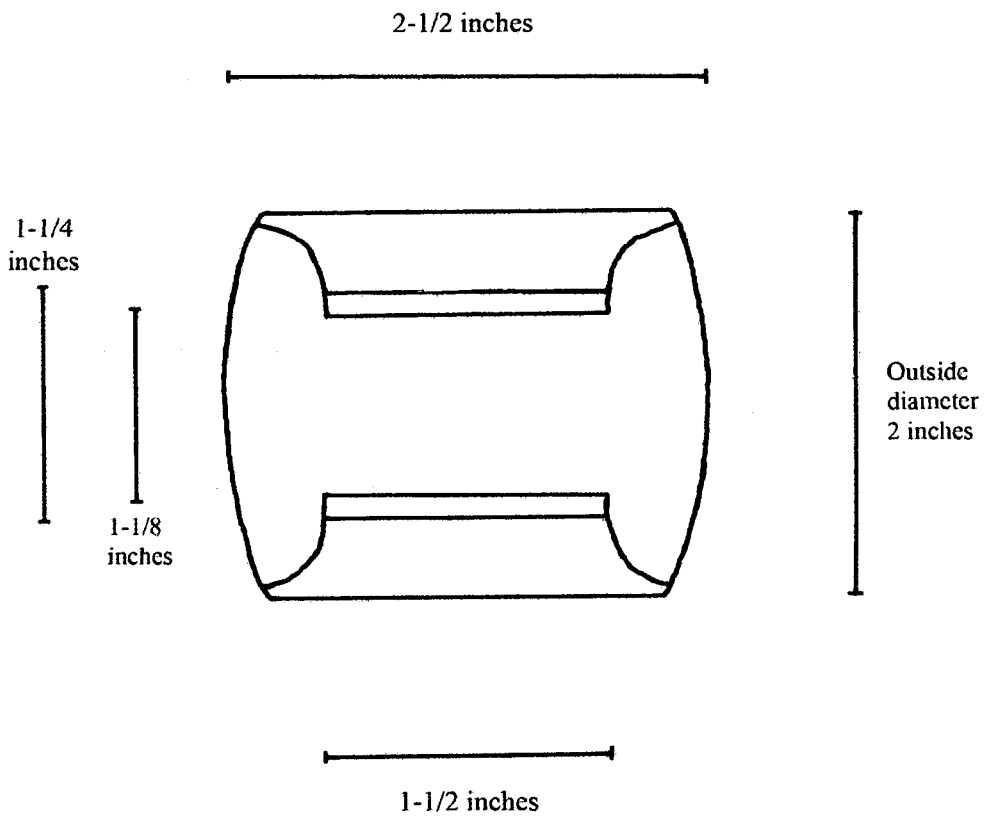
FIG. 2C is a bottom plan view of the version shown in FIG. 2A.

FIG. 2C is a schematic view of the bottom of the "clasp".

The view of the bottom of the "clasp" shows its design and dimensions. It shows the open gap at the bottom of the "clip". This open gap fits over and around the "roller".

The width of the gap at the inner surface of the "clasp" measures 1 1/8 inch. The width of the gap at the outer surface measures 1 1/4 inches. The sides of the gap are angled from the outside inward to facilitate placing the "clasp" over and around the "roller".

The length of the top surface of the "clasp" is 2½ inches. The length of the bottom of the "clasp" is 1½ inches.

The lower two rows of universal hairpin holes are not shown in this illustration. However, they are located at a 55 degree angle below the top rows of universal holes. They exactly match the size and positions of the lower rows of universal hairpin holes on the "roller".

Figure 3:
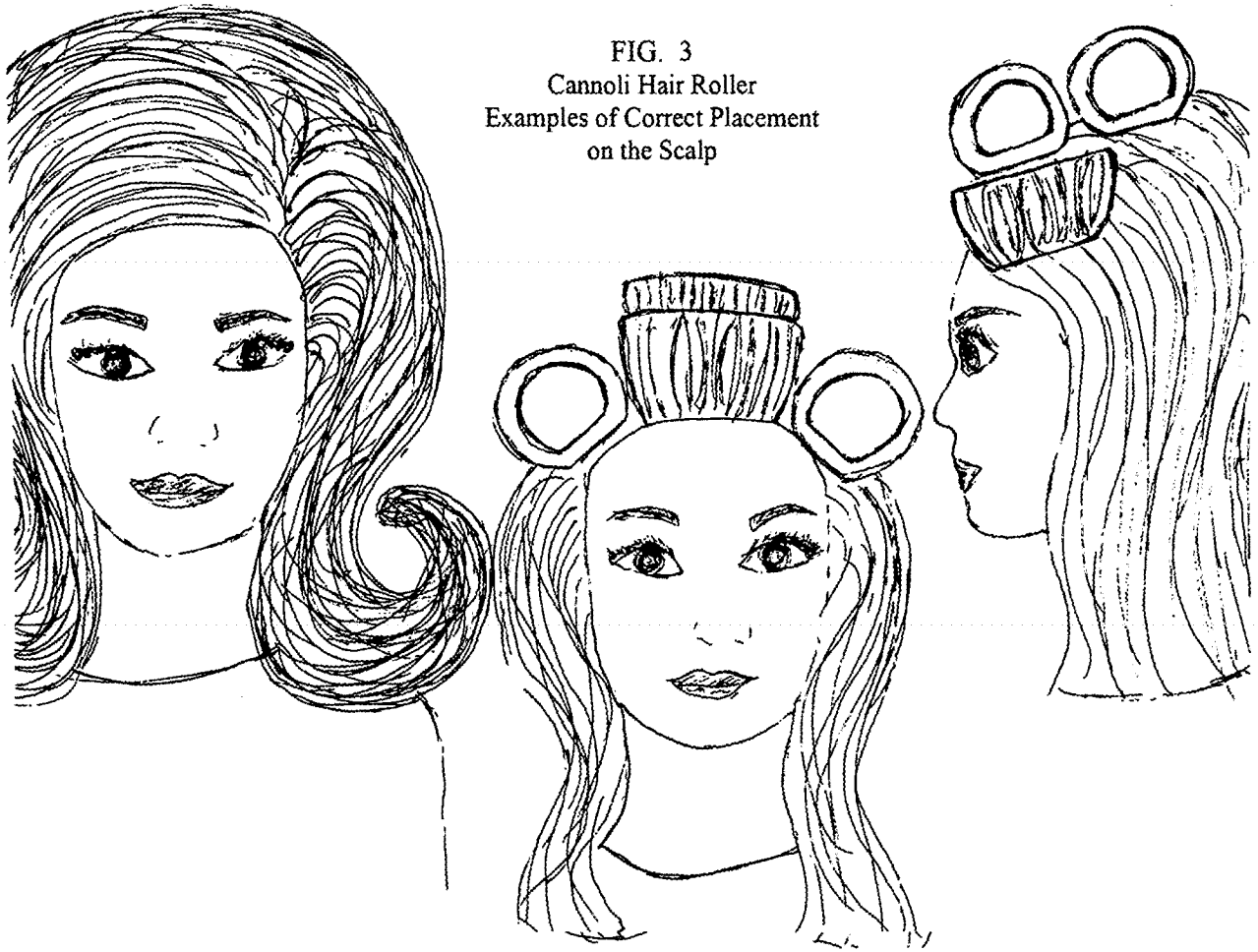
FIG. 3 is an illustrative example of a plurality of hair rollers as applied to the head of a user.

FIG. 3 Shows a few of the "inventions" i.e. "rollers and clips" positioned properly on the head with hair wound around them. It is important to note the flat bottom surface of the "rollers" are positioned onto the scalp. Also, it should be noted that any loose hair ends are shown to be rolled underneath the rollers.

As described above, the present invention, the Cannoli Hair Roller and Cannoli Hair Clasp, is a new and unique hair roller design. It is designed to be easily and perfectly placed "on base" on the head and to remain perfectly "on base" while being worn. The overall shape of the "invention" allows more space for the hair setter's fingers and quicker and easier hair sets. Also, the shape of the "invention" minimizes roller rocking and bumping between rollers and stray hair ends slipping out of the "roller".

The Cannoli Hair Clasp is specifically designed to be used with the Cannoli Hair Roller to secure it in place. The shape and dimensions of the Cannoli Hair Roller specifically complement the Cannoli Hair Clasp.

The correct procedure for applying the "roller" differs slightly from that for conventional hair rollers. With the "roller" first take a hair parting from a subdivided "roller" base. Gently lift the hair strand away from the scalp and place the side of the "roller" against the middle of the hair strand. Then wrap the hair strand once around the "roller placing the hair under gentle tension, while lowering the "roller's" flat bottom to the scalp. When the flat bottom of the "roller" is seated on the scalp, or "on base", then wrap any loose hair ends under the hair strand already wound on the "roller" with the tail-end of a teasing comb. Then the "roller" can be secured in place with the "clasp" and/or additional universal hair pins and universal hair clips.

The open gap of the "clasp" is gently slipped over the "roller" from the top downward.

The construction of the "invention" can be achieved by a variety of means such as injection molding, 3D printing, or even hand crafting techniques. The materials it can be crafted from are numerous such as: plastic, cardboard, wood, metal, or any other material that can be crafted into the "invention's" unique design and still retain its form under mild pressure and over an extended period of time. The most likely method in industry for production of the "invention" would be a rigid plastic material shaped in an injection molding machine. The process and materials used to create the "invention" are not unique, nor a part of what is claimed hereafter.

The invention claimed is:

1. A hair roller having a longitudinal axis operable to adhere to a scalp, the hair roller comprising:

a first and second ends, first and second sides, a top and a bottom;

a tubular wall extending between the ends comprising a substantially planar bottom surface and a top cylindrical portion extending above the bottom surface;

wherein the first and second ends are angled relative to the longitudinal axis generally extending outward from the bottom surface; and wherein the cylindrical portion longitudinal length is greater than the bottom surface longitudinal length.

2. The hair roller of claim 1, further comprising a clasp member comprising an open framework in the form of a resilient split sleeve adapted to be sprung over the hair roller.

3. The hair roller of claim 1, wherein the bottom surface further comprises outwardly opening base notches at each end along a centerline in order to receive universal hair clips used to secure the hair roller to the scalp.

4. The hair roller of claim 1, further comprising a plurality of spaced apart holes extending at least through the cylindrical top portion, the spaced apart holes are aligned in rows on each side of the cylindrical top portion, each side having mirrored numbers of rows and holes configured to receive universal hair pins passed therethrough.

5. The hair roller of claim 4, wherein the plurality of spaced apart holes are grouped into a bottom row and a top row on each of the first and second side of the cylindrical top portion.

6. The hair roller of claim 5, wherein each of the bottom rows has three holes, and each of the top rows has five holes.

7. A hair roller having a longitudinal axis operable to adhere to a scalp, the hair roller comprising:

a first and second ends;

a tubular wall extending between the ends; wherein the tubular wall comprises a bottom surface and a top cylindrical portion, the bottom surface having a first and second ends defining a longitudinal length and lateral first and second sides, the top cylindrical portion extending above the bottom surface adjoined at each of the lateral first and second sides; wherein the top cylindrical portion increases in length extending from the bottom surface to the top forming the ends at an angle with respect to the longitudinal axis;

a plurality of spaced apart holes extending at least through the cylindrical top portion, the holes are aligned in rows on each side of the top portion, each side having mirrored numbers of rows and holes configured to receive universal hair pins passed therethrough.

8. The hair roller of claim 7, further comprising a clasp member comprising an open framework in the form of a resilient split sleeve adapted to couple with the hair roller.

9. The hair roller of claim 7, wherein the bottom surface further comprises outwardly opening base notches at each end along a centerline in order to receive universal hair clips used to secure the hair roller to the scalp.

10. The hair roller of claim 7 wherein the bottom surface is substantially planar.

11. The hair roller of claim 7, wherein the plurality of spaced apart holes are grouped into a bottom row and a top row on each of the first and second side of the cylindrical top portion.

12. The hair roller of claim 11, wherein each of the bottom rows have three holes and each of the top rows have five holes.

13. A hair roller set having a longitudinal axis operable to adhere to a scalp, the hair roller set comprising:

a hair roller comprising:

a first and second ends, first and second sides, top and bottom;

a tubular wall extending between the ends comprising a substantially planar bottom surface and a top cylindrical portion having opposing first and second sides and extending above the bottom surface; and wherein the first and second ends are angled relative to the longitudinal axis generally extending outward from the bottom surface; and wherein the cylindrical portion longitudinal length is greater than the bottom surface longitudinal length; and a hair clasp comprising:

a first and second ends, opposing first and second sides, top and bottom; open framework extending between the ends in the form of a resilient split sleeve adapted to attach over the hair roller;

and wherein the first and second ends are angled relative to the longitudinal axis extending outward from near the bottom replicating the shape of the first and second ends of the hair roller.

14. The hair roller set of claim 13, wherein the bottom surface further comprises outwardly opening base notches at each end along the centerline in order to receive universal hair clips used to secure the hair roller to the scalp.

15. The hair roller set of claim 13, wherein the open framework of the hair clasp further comprises a cylindrical body forming a bottom gap defined between opposing bottom perimeters, each opposing bottom perimeters having a flat tab extending the length thereof which is operable to adapt and couple with the bottom surface of the hair roller while clasped thereto.

16. The hair roller set of claim 15, wherein the hair roller further comprises a plurality of spaced apart holes extending at least through the cylindrical top portion, the holes are aligned in rows on each side of the cylindrical top portion, each side having mirrored numbers of rows and holes configured to receive universal hair pins passed therethrough.

17. The hair roller set of claim 16, wherein the hair clasp further comprises a plurality of spaced apart holes extending through the hair clasp, the holes are aligned in rows on each side of the hair clasp, each side having mirrored numbers of rows and holes configured to receive universal hair pins passed therethrough.

18. The hair roller set of claim 17, wherein while the hair clasp is coupled with the hair roller, the hair clasp plurality of holes operably align with the hair roller plurality of holes in order allow passage of universal pins therethrough.

19. The hair roller set of claim 18, wherein the plurality of spaced apart holes for each of the hair roller and the hair clasp are grouped into a bottom row and a top row on each of the first and second side of the cylindrical top portion.

20. The hair roller set of claim 19, wherein each of the bottom rows has three holes, and each of the top rows has five holes.

* * * * *